US006739015B1

(12) United States Patent
Berthold et al.

(10) Patent No.: US 6,739,015 B1
(45) Date of Patent: May 25, 2004

(54) CLEANING BRUSH DEVICE

(76) Inventors: Erwin Berthold, 12455 SW. 93rd Ter. #102-T, Miami, FL (US) 33186; Juan J. Leon, 12810 SW. 107th Ter., Miami, FL (US) 33186

( * ) Notice: Subject to any disclaimer, the term of this patent is extended or adjusted under 35 U.S.C. 154(b) by 194 days.

(21) Appl. No.: 09/965,723

(22) Filed: Sep. 27, 2001

(51) Int. Cl.[7] ..... A46B 5/02; A46B 5/04

(52) U.S. Cl. ..... 15/159.1; 15/143.1; 15/227; 15/111

(58) Field of Search ..... 15/143.1, 159.1, 15/227, 171, 111

(56) References Cited

U.S. PATENT DOCUMENTS

| | | | | | |
|---|---|---|---|---|---|
| 101,307 | A | * | 3/1870 | Feazoil | |
| 462,943 | A | | 11/1891 | Ferguson | |
| D25,895 | S | | 8/1896 | Young | |
| 1,182,038 | A | | 5/1916 | Rebel | |
| 2,432,264 | A | * | 12/1947 | Tyler | 15/207.2 |
| 2,674,758 | A | * | 4/1954 | Fay | 15/160 |
| 2,795,808 | A | * | 6/1957 | Wiest | 15/227 |
| 2,958,889 | A | * | 11/1960 | Greenblatt | 15/187 |
| 2,988,049 | A | * | 6/1961 | Bean | 119/633 |
| D247,075 | S | * | 1/1978 | Krusche | D4/117 |
| 4,606,091 | A | | 8/1986 | Sartori | |
| 5,987,687 | A | * | 11/1999 | Kilburn | 15/145 |
| 6,081,958 | A | | 7/2000 | Van Staagen | |
| 6,151,746 | A | | 11/2000 | Lewis | |
| 6,499,175 | B1 | * | 12/2002 | Osiecki et al. | 15/159.1 |

* cited by examiner

*Primary Examiner*—Robert J. Warden, Sr.
*Assistant Examiner*—Shay Balsis

(57) ABSTRACT

A cleaning brush device for preventing fatigue to the hand while cleaning. The cleaning brush device includes a panel having a top surface, a bottom surface and a peripheral edge extending between the top and bottom surfaces. A plurality of bristles is attached to and extends away from the bottom surface of the panel. A gripping member is attached to the top surface. The gripping member extends upwardly from the top surface in an arcuate manner. The gripping member is contoured to the general shape of a hand.

11 Claims, 1 Drawing Sheet

CLEANING BRUSH DEVICE

BACKGROUND OF THE INVENTION

1. Field of the Invention

The present invention relates to cleaning devices and more particularly pertains to a new cleaning brush device for preventing fatigue to the hand while cleaning.

2. Description of the Prior Art

The use of cleaning devices is known in the prior art. More specifically, cleaning devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 6,081,958; 462,943; 1,182,038; 6,151,746; 4,606,091; and U.S. Des. Pat. No. 25,895.

While these devices fulfill their respective, particular objectives and requirements, the aforementioned patents do not disclose a new cleaning brush device. The inventive device includes a panel having a top surface, a bottom surface and a peripheral edge extending between the top and bottom surfaces. A plurality of bristles is attached to and extends away from the bottom surface of the panel. A gripping member is attached to the top surface. The gripping member extends upwardly from the top surface in an arcuate manner. The gripping member is contoured to the general shape of a hand.

In these respects, the cleaning brush device according to the present invention substantially departs from the conventional concepts and designs of the prior art, and in so doing provides an apparatus primarily developed for the purpose of preventing fatigue to the hand while cleaning.

SUMMARY OF THE INVENTION

In view of the foregoing disadvantages inherent in the known types of cleaning devices now present in the prior art, the present invention provides a new cleaning brush device construction wherein the same can be utilized for preventing fatigue to the hand while cleaning.

The general purpose of the present invention, which will be described subsequently in greater detail, is to provide a new cleaning brush device apparatus and method which has many of the advantages of the cleaning devices mentioned heretofore and many novel features that result in a new cleaning brush device which is not anticipated, rendered obvious, suggested, or even implied by any of the prior art cleaning devices, either alone or in any combination thereof.

To attain this, the present invention generally comprises a panel having a top surface, a bottom surface and a peripheral edge extending between the top and bottom surfaces. A plurality of bristles is attached to and extends away from the bottom surface of the panel. A gripping member is attached to the top surface. The gripping member extends upwardly from the top surface in an arcuate manner. The gripping member is contoured to the general shape of a hand.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning brush device apparatus and method which has many of the advantages of the cleaning devices mentioned heretofore and many novel features that result in a new cleaning brush device which is not anticipated, rendered obvious, suggested, or even implied by any of the prior art cleaning devices, either alone or in any combination thereof.

It is another object of the present invention to provide a new cleaning brush device which may be easily and efficiently manufactured and marketed.

It is a further object of the present invention to provide a new cleaning brush device which is of a durable and reliable construction.

An even further object of the present invention is to provide a new cleaning brush device which is susceptible of a low cost of manufacture with regard to both materials and labor, and which accordingly is then susceptible of low prices of sale to the consuming public, thereby making such cleaning brush device economically available to the buying public.

Still yet another object of the present invention is to provide a new cleaning brush device which provides in the apparatuses and methods of the prior art some of the advantages thereof, while simultaneously overcoming some of the disadvantages normally associated therewith.

Still another object of the present invention is to provide a new cleaning brush device for preventing fatigue to the hand while cleaning.

Yet another object of the present invention is to provide a new cleaning brush device which includes a panel having a top surface, a bottom surface and a peripheral edge extending between the top and bottom surfaces. A plurality of bristles is attached to and extends away from the bottom surface of the panel. A gripping member is attached to the top surface. The gripping member extends upwardly from the top surface in an arcuate manner. The gripping member is contoured to the general shape of a hand.

Still yet another object of the present invention is to provide a new cleaning brush device that has a grip member and a securing means so that a persons hands feel comfortable on the brush and are not fatigued.

These together with other objects of the invention, along with the various features of novelty which characterize the invention, are pointed Out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
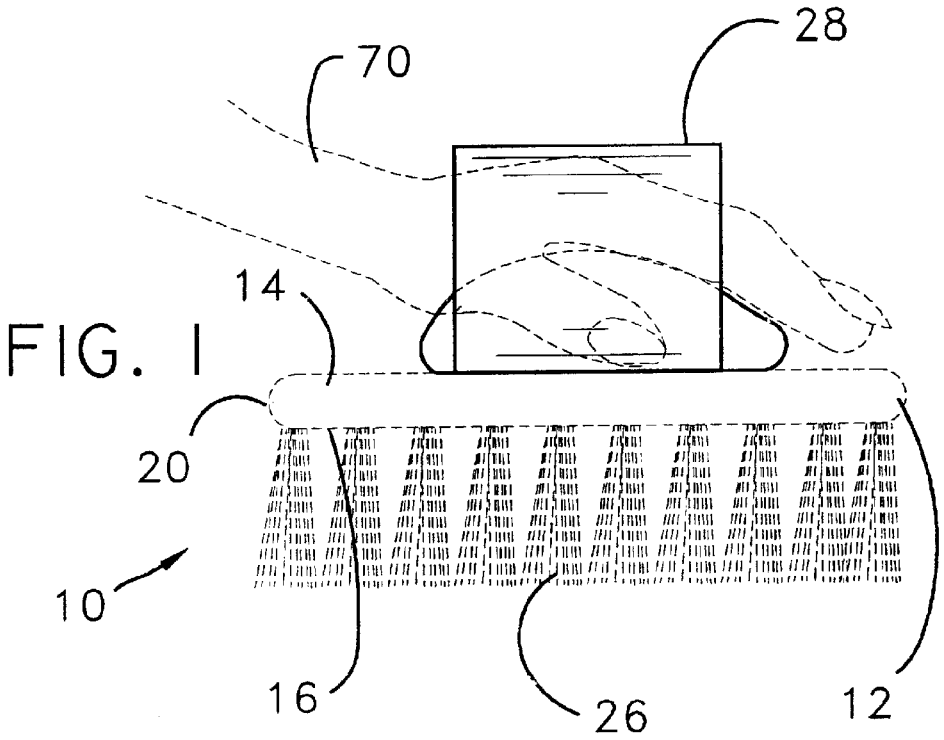
FIG. 1 is a schematic side view of a new cleaning brush device according to the present invention.
Figure 2:
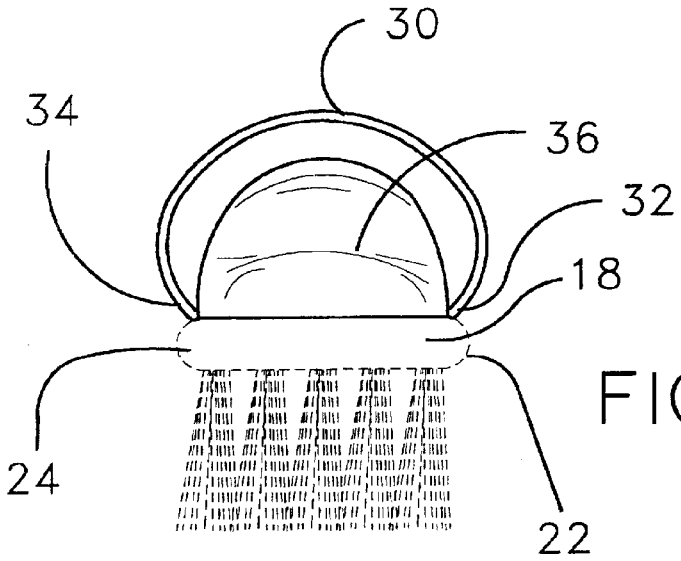
FIG. 2 is a schematic end view of the present invention.

With reference now to the drawings, and in particular to FIGS. 1 through 2 thereof, a new cleaning brush device embodying the principles and concepts of the present invention and generally designated by the reference numeral 10 will be described.

As best illustrated in FIG. 1 through 2, the cleaning brush device generally comprises a panel 12 having a top surface 14, a bottom surface and a peripheral edge extending between the top 14 and bottom 16 surfaces. The top surface 14 has a generally rectangular shape such that he peripheral edge includes a front edge 18, a back edge 20, a first side edge 22 and a second side edge 24. The panel 12 comprises a rigid material A plurality of bristles 26 is attached to and extends away from the bottom surface 16 of the panel 12.

A securing means 28 is attached to the panel 12 for removably securing the panel to the hand 70 of a user. The securing means 28 comprises a strap 30 having a first end 32 and a second end 34. The first end 32 is attached to the first side edge 22 and the second end 34 is attached to the second side edge 24. The strap 30 comprises a resiliently stretchable cloth material.

A gripping member 36 is attached to the top surface 14. The gripping member 36 is positioned between the front 18 and back 20 edges. The gripping member 36 extends upwardly from the top surface 14 in an arcuate manner. The gripping member 36 is contoured to the general shape of a hand 70. The gripping member 36 ideally comprises a flexible container having a silicon gel therein.

In use, the user places the strap 30 around their hand 70 with their palm on the gripping member 36. Cleaning is then done as with a typical cleaning brush. The gripping member 36 and strap 30 prevent fatigue to the hand.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cleaning utensil comprising:

a panel having a top surface, a bottom surface and a peripheral edge extending between said top and bottom surfaces, said top surface having a generally rectangular shape such that said peripheral edge includes a front edge, a back edge, a first side edge and a second side edge, said panel comprising a rigid material, a plurality of bristles being attached to and extending away from said bottom surface of said panel;

a securing means being attached to said panel for removably securing said panel to the hand of a user, said securing means comprising a strap having a first end and a second end, said first end being attached to said first side edge and said second end being attached to said second side edge, said strap comprising a resiliently stretchable cloth material; and a gripping member being attached to said top surface, said gripping member being positioned between said front and back edges, said gripping member extending upwardly from said top surface in an arcuate manner, said gripping member being contoured to the general shape of a hand, said gripping member comprising a flexible container having a silicon gel therein.

2. A holder assembly for use with a conventional brush having a rigid flat panel and a plurality of bristles being attached to and extending away from a bottom surface of the panel, the holder assembly comprising:

a gripping member being engagable to the flat panel of the brush, the gripping member being adapted for being placed in a palm of a user;

a securing means operationally coupled to said gripping member for selectively securing said gripping member to a hand of the user;

wherein said securing means comprises a strap having a first end and a second end, said first end being attached to a first side edge of said gripping member and said second end being attached to a second side edge of said gripping member; and wherein said strap comprises a resiliently stretchable material.

3. The holder assembly of claim 2, wherein said gripping member further comprises:

a flat bottom wall adapted for abutting a top surface of the flat panel of the brush; and a arcuate upper wall coupled to a perimeter edge of said flat bottom wall, said arcuate upper wall extending away from said flat bottom wall as it extends away from said perimeter edge.

4. The holder assembly of claim 3, wherein said flat bottom wall comprising a resiliently flexible material for frictionally engaging the top surface of the flat panel of the brush whereby moving said gripping member along a horizontal plane moves the brush.

5. The holder assembly of claim 3, wherein said flat bottom wall comprises silicone.

6. The holder assembly of claim 3, wherein said flat bottom wall and said arcuate upper wall define an interior space, said arcuate upper wall being resiliently flexible.

7. The holder assembly of claim 6, wherein said interior space being filled with a gel material for supporting the palm of the user while allowing said gripping material to be temporarily deformed.

8. The holder assembly of claim 2, further comprising:

said gripping member having a flat bottom wall and an arcuate upper wall, said flat bottom wall being adapted for abutting a top surface of the flat panel of the brush, said arcuate upper wall being coupled to a perimeter edge of said flat bottom wall, said arcuate upper wall extending away from said flat bottom wall as it extends away from said perimeter edge;

said flat bottom wall comprising a resiliently flexible material for frictionally engaging the top surface of the flat panel of the brush whereby moving said gripping member along a horizontal plane moves the brush;

said flat bottom wall and said arcuate upper wall defining an interior space, said arcuate upper wall being resiliently flexible; and said interior space being filled with a gel material for supporting the palm of the user while allowing said gripping material to be temporarily deformed.

9. The holder assembly of claim 2, wherein said securing means comprises a strap having a first end and a second end, said first end being attached to a first side edge of said gripping member and said second end being attached to a second side edge of said gripping member.

10. The holder assembly of claim 2, wherein said strap comprises a resiliently stretchable material.

11. A holder assembly for use with a conventional brush having a rigid flat panel and a plurality of bristles being attached to and extending away from a bottom surface of the panel, the holder assembly comprising:

a gripping member being engagable to the flat panel of the brush, the gripping member being adapted for being placed in a palm of a user said gripping member having a flat bottom wall and an arcuate upper wall, said flat bottom wall being adapted for abutting a top surface of the flat panel of the brush, said arcuate upper wall being coupled to a perimeter edge of said flat bottom wall, said arcuate upper wall extending away from said flat bottom wall as it extends away from said perimeter edge;

said flat bottom wall comprising a resiliently flexible material for frictionally engaging the top surface of the flat panel of the brush whereby moving said gripping member along a horizontal plane moves the brush;

said flat bottom wall and said arcuate upper wall defining an interior space, said arcuate upper wall being resiliently flexible; and said interior space being filled with a gel material for supporting the palm of the user while allowing said gripping material to be temporarily deformed;

a securing means operationally coupled to said gripping member for selectively securing said gripping member to a hand of the user;

said securing means comprises a strap having a first end and a second end, said first end being attached to a first side edge of said gripping member and said second end being attached to a second side edge of said gripping member; and wherein said strap comprises a resiliently stretchable material.

* * * * *